US009376635B2

(12) United States Patent
McGrady et al.

(10) Patent No.: US 9,376,635 B2
(45) Date of Patent: Jun. 28, 2016

(54) CARBONACEOUS MATERIAL UPGRADING USING SUPERCRITICAL FLUIDS

(75) Inventors: Gerard Sean McGrady, Lincoln (CA); Sarah Ann Brough, Fredericton (CA); Christopher Willson, Fredericton (CA)

(73) Assignees: HSM Systems, Inc., Fredericton, New Brunswick (CA); University of New Brunswick, Fredericton, New Brunswick (CA)

( * ) Notice: Subject to any disclaimer, the term of this patent is extended or adjusted under 35 U.S.C. 154(b) by 494 days.

(21) Appl. No.: 12/708,898

(22) Filed: Feb. 19, 2010

(65) Prior Publication Data

US 2011/0000825 A1 Jan. 6, 2011

Related U.S. Application Data

(63) Continuation-in-part of application No. 12/663,843, filed as application No. PCT/US2008/066545 on Jun. 11, 2008.

(60) Provisional application No. 61/153,711, filed on Feb. 19, 2009, provisional application No. 61/157,583, filed on Mar. 5, 2009, provisional application No. 61/279,958, filed on Oct. 28, 2009, provisional application No. 61/257,459, filed on Nov. 2, 2009, provisional application No. 61/293,888, filed on Jan. 11, 2010, provisional application No. 60/943,173, filed on Jun. 11, 2007.

(51) Int. Cl.

| | |
|---|---|
| ***C10G 1/00*** | (2006.01) |
| ***C10G 21/08*** | (2006.01) |
| ***C10G 1/06*** | (2006.01) |
| ***C10G 21/14*** | (2006.01) |

(52) U.S. Cl.
CPC ..... *C10G 21/08* (2013.01); *C10G 1/065* (2013.01); *C10G 21/14* (2013.01)

(58) Field of Classification Search
CPC ..... C10G 1/047
USPC ..... 208/390, 391, 400, 413, 419, 428, 49, 208/107–112
See application file for complete search history.

(56) References Cited

U.S. PATENT DOCUMENTS

| | | | | |
|---|---|---|---|---|
| 3,960,706 | A * | 6/1976 | McCollum et al. | 208/112 |
| 4,363,717 | A * | 12/1982 | Pelrine et al. | 208/108 |
| 2006/0163117 | A1 * | 7/2006 | Hong | 208/125 |

FOREIGN PATENT DOCUMENTS

| | | |
|---|---|---|
| WO | WO0039251 | 7/2000 |
| WO | WO02081239 | 11/2001 |
| WO | WO02866018 | 10/2002 |

OTHER PUBLICATIONS

ISR for PCT/US2008/066545 issued Oct. 13, 2008.

* cited by examiner

*Primary Examiner* — Michelle Stein
(74) *Attorney, Agent, or Firm* — Milstein Zhang & Wu LLC; Joseph B. Milstein

(57) ABSTRACT

Systems and methods for extracting, handling and upgrading carbonaceous material. The systems and methods involve forming a reaction mixture of a carbonaceous material, a supercritical fluid, a catalyst and a source of hydrogen, and maintaining the reaction mixture at moderate temperatures for modest time periods. Exemplary reaction temperatures are those below 200° C. Exemplary reaction times range from 30 minutes to less than 24 hours.

18 Claims, 10 Drawing Sheets

Anthracene

Phenanthrene

Pyrene

CARBONACEOUS MATERIAL UPGRADING USING SUPERCRITICAL FLUIDS

CROSS-REFERENCE TO RELATED APPLICATIONS

This application claims priority to and the benefit of U.S. provisional patent application Ser. No. 61/153,711 filed Feb. 19, 2009, U.S. provisional patent application Ser. No. 61/157,583 filed Mar. 5, 2009, U.S. provisional patent application Ser. No. 61/279,958 filed Oct. 28, 2009, U.S. provisional patent application Ser. No. 61/257,459 filed Nov. 2, 2009, U.S. provisional patent application Ser. No. 61/293,888 filed Jan. 11, 2010, and is a continuation-in-part of co-pending U.S. patent application Ser. No. 12/663,843 filed Dec. 10, 2009, which in turn claimed the priority and benefit of PCT/US2008/066545 filed Jun. 11, 2008, which in turn claimed the benefit and priority of U.S. provisional patent application Ser. No. 60/943,173 filed Jun. 11, 2007, each of which applications is incorporated herein by reference in its entirety.

STATEMENT REGARDING FEDERALLY FUNDED RESEARCH OR DEVELOPMENT

NOT APPLICABLE.

THE NAMES OF THE PARTIES TO A JOINT RESEARCH AGREEMENT

NOT APPLICABLE.

INCORPORATION-BY-REFERENCE OF MATERIAL SUBMITTED ON A COMPACT DISC

NOT APPLICABLE.

FIELD OF THE INVENTION

This invention relates to the extraction and upgrading of fossil fuels and in particular, the upgrading of bitumen using supercritical fluids.

BACKGROUND OF THE INVENTION

The Substrate

The bitumen deposits in the Athabasca tar sands in Alberta, Canada are estimated to contain at least 1.7 trillion barrels of oil, and as such may represent around one-third of the world's total petroleum resources. Over 85% of known bitumen reserves lie in this deposit, and their high concentration makes them economically recoverable. Other significant deposits of tar sands exist in Venezuela and the USA, and similar deposits of oil shale are found in various locations around the world. These deposits consist of a mixture of clay or shale, sand, water and bitumen.

Bitumen is a viscous, tar-like material composed primarily of polycyclic aromatic hydrocarbons (PAHs). PAHs have a low hydrogen-to-carbon content and are difficult to extract and process. Extraction of the useful bitumen in tar sands is a non-trivial operation, and many processes have been developed or proposed. Lower viscosity deposits can be pumped out of the sand, but more viscous material is generally extracted with superheated steam, using processes known as cyclic steam stimulation (CSS) or steam assisted gravity drainage (SAGD). More recently, this latter technology has been adapted to use hydrocarbon solvents instead of steam, in a vapor extraction (VAPEX) process. Supercritical fluids (SCFs) have been considered a potentially attractive extractant for bituminous deposits since the 1970s. Their low densities and low viscosities make them particularly effective at permeating tar sands and oil shales and extracting organic deposits, and the energy costs associated with the moderate temperatures and pressures required to produce them compare very favourably with those processes that use superheated steam. For example, bitumen has been successfully recovered from Stuart oil shale in Queensland using supercritical carbon (sc) dioxide ($scCO_2$), and from Utah oil sands using supercritical propane (sc propane). Very recently, Raytheon announced the use of $scCO_2$ in combination with RF heating to extract oil shale deposits beneath Federal land in Colorado, Utah and Wyoming.

Bitumen typically contains around 83% carbon, 10% hydrogen and 5% sulfur by weight, along with significant ppm amounts of transition metals like vanadium and nickel associated with porphyrin residues. This low-grade material commonly needs to be converted into synthetic crude oil or refined directly into petroleum products before it can be used for most applications. Typically, this is carried out by catalytic cracking, which redistributes the hydrogen in the material. Catalytic cracking produces a range of 'upgraded' organic products with relatively high hydrogen content, but leaves behind a substance known as asphaltene, which is even more intractable than bitumen and contains very little hydrogen. Unless this asphaltene is upgraded by reaction with hydrogen, it is effectively a waste product.

Catalytic hydrogenation of organic molecules is of vital importance in the fine chemicals and petrochemicals industries. Solution phase reactions employing $H_2$ as the hydrogen source are usually slow, on account of the low solubility of this gas in conventional organic solvents. In recent years, supercritical carbon dioxide ($scCO_2$) has emerged as an attractive alternative to conventional solvents for several reasons. These include its low cost and toxicity, the abundance of $CO_2$ in the atmosphere, and the modest temperature and pressure required to form a supercritical phase. In addition, the use of $scCO_2$ in place of organic solvents is increasingly viewed as an environmentally attractive substitution. In contrast to a conventional solvent environment, $H_2$ is completely miscible with $scCO_2$, and supercritical $CO_2/H_2$ mixtures have been the subject of much interest as reaction media for several hydrogenation processes.

Polycyclic aromatic hydrocarbons (PAHs) occur widely in terrestrial and extraterrestrial environments. Their high aromatic stabilisation energy renders them a thermodynamically favourable product of a variety of chemical processes. Thus, they are major constituents of heavy oils and coal deposits, where they arise from degradation of natural products such as steroids and porphyrins. They also appear to be widely distributed in interstellar space, where they are believed to be responsible for the cosmic unidentified infrared emission bands. Their low H:C ratio and high molecular weights means that PAHs have to be upgraded through catalytic cracking and hydrogenation before they can be used as a feedstock for conventional chemical or petrochemical processes.

Catalytic hydrogenation of simple PAHs such as naphthalene and anthracene has been achieved using severe reaction conditions (>300° C.; 5 MPa $H_2$). The high aromatic stabilisation of fused-ring systems such as these renders them challenging substrates to hydrogenate, leading to lower reaction rates (relative rates of hydrogenation compared to benzene: benzene to cyclohexane=1, phenanthrene to tetrahydroanthracene=0.7). There have been sporadic reports in the literature describing the hydrogenation of PAHs under milder conditions. Thus, Shirai and co-workers achieved conversion of naphthalene to decalin in $scCO_2$ at 60° C. with a Rh/C catalyst and $H_2$ (6 MPa), and Marshall et al. reported catalytic hydrogenation of a variety of PAHs (μmol scale) under mild conditions in the presence of supported Pd using hexane or $scCO_2$ as a solvent. Metalloporphyrin catalysts have also been used to achieve partial hydrogenation of naphthalene, anthracene and phenanthrene. However, there remains significant scope for improvements in these methods through a systematic approach.

A number of problems in extracting, handling and upgrading bitumen have been observed.

There is a need for systems and methods that allow for efficient, cost-effective and rapid processing of bitumen.

SUMMARY OF THE INVENTION

In one aspect, the invention relates to a method of extracting and upgrading carbonaceous material. The method comprises the steps of contacting a specimen of carbonaceous material with a supercritical fluid, a catalyst and a source of hydrogen to form a reaction mixture; maintaining the specimen of carbonaceous material with a supercritical fluid, a catalyst and a source of hydrogen in the reaction mixture at a temperature of 200° C. or less for a reaction time of at least 30 minutes; and recovering extracted hydrocarbon from the reaction mixture.

In some embodiments, the specimen of carbonaceous material comprises a material selected from the group consisting of an oil sand, a bitumen, an oil shale, a lignite, a coal, a tar sand, and a biofuel.

In some embodiments, the specimen of carbonaceous material comprises a polycyclic aromatic hydrocarbon. In some embodiments, the polycyclic aromatic hydrocarbon undergoes hydrogenation. In some embodiments, the polycyclic aromatic hydrocarbon undergoes a ring opening reaction. In some embodiments, the carbonaceous material undergoes a sulfur elimination reaction. In some embodiments, the maintaining step is performed at a temperature of 160° C. or less. In some embodiments, the maintaining step is performed at a temperature of 120° C. or less. In some embodiments, the maintaining step is performed at a temperature of 100° C. or less. In some embodiments, the maintaining step is performed at a temperature of 60° C. or less. In some embodiments, the supercritical fluid comprises $CO_2$. In some embodiments, the supercritical fluid comprises a hydrocarbon. In some embodiments, the catalyst comprises rhodium. In some embodiments, the catalyst comprises a support of carbon or aluminum oxide. In some embodiments, the catalyst comprises a metal selected from the group consisting of Fe, Ni, Mo, W, Ru, Pd, Ir and Pt. In some embodiments, the step of recovering extracted hydrocarbon comprises recovering a liquid or gaseous product that is suitable for transport by pipeline.

In another aspect, the invention features a method of upgrading carbonaceous material. The method comprises the steps of: contacting a specimen of carbonaceous material with a supercritical fluid, a catalyst and a source of hydrogen to form a reaction mixture; maintaining the specimen of carbonaceous material with a supercritical fluid, a catalyst and a source of hydrogen in the reaction mixture at a temperature of 200° C. or less for a reaction time of at least 30 minutes; and recovering hydrocarbon from the reaction mixture.

In some embodiments, the step of recovering hydrocarbon comprises recovering a liquid or gaseous product that is suitable for transport by pipeline. In some embodiments, the specimen of carbonaceous material comprises a material selected from the group consisting of an oil sand, a bitumen, an oil shale, a lignite, a coal, a tar sand, and a biofuel. In some embodiments, the supercritical fluid comprises $CO_2$.

The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

DETAILED DESCRIPTION

Figure 1:
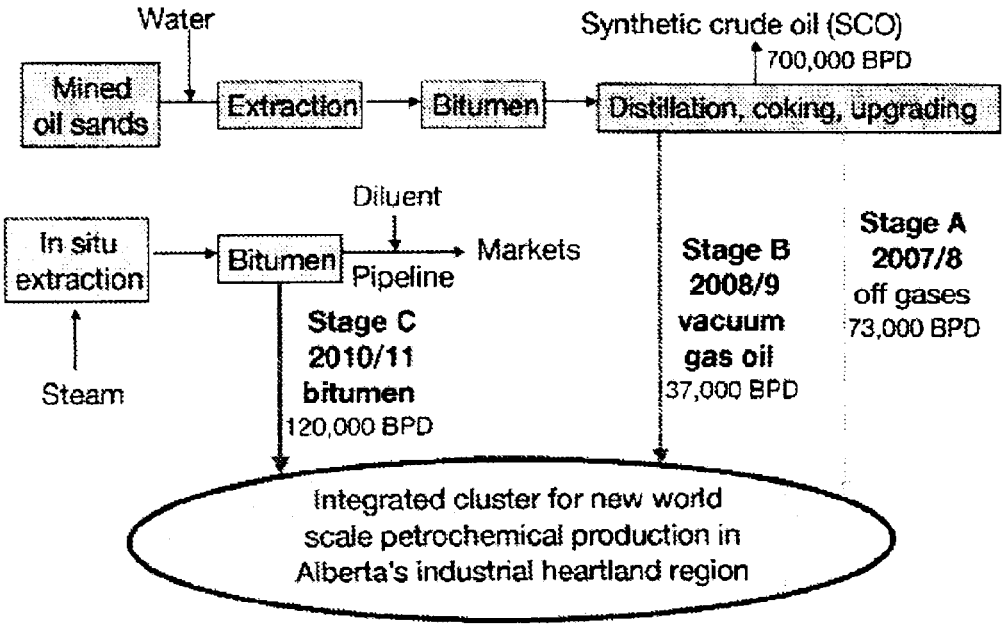
FIG. 1 is a schematic diagram of an oil sands petrochemicals process with integrated distillation, coking and upgrading.

This invention teaches a combined SCF process for extracting and upgrading bitumen, thereby enabling a more efficient and integrated procedure for use in the processing of low-grade petroleum deposits in tar sands and/or oil shales. While supercritical fluids have been used to extract oil and bituminous materials from sand and shale deposits, and have been used as reaction media for a range of homogeneous and heterogeneous chemical processes, they have never been used in the combined extraction/chemical reaction process of this invention. In this invention, mining or in situ extraction produces bitumen that feeds into a combined distillation, coking and upgrading process.

Also described are procedures for mobilizing carbonaceous materials such as bitumen by increasing its API gravity and lowering its viscosity. As such the methods described are expected to permit a carbonaceous material to be treated at or close to the extraction site, then sent to a refinery many miles away in a conventional pipeline. A recent article by Jim Colyar entitled "Has the time for partial upgrading of heavy oil and bitumen arrived?" that appeared in Petroleum Technology Quarterly $4^{th}$ Quarter 2009 points out some of the problems present in handling bitumen. In particular, heavy oil and bitumen are too heavy and viscous to be transported via pipeline from the field to refining facilities. Currently, only full upgrading of Western Canadian heavy oil and bitumen is applied commercially. Full upgrading produces synthetic crude oil that resembles high quality light oil and contains very little or no vacuum residue. Partial upgrading has not been commercialized due to the lack of technology that can economically produce a specification synthetic crude oil, issues related to stability and concerns about adequate pricing of the sour synthetic crude oil.

Solubility and Extraction of Bitumen in SCFs

Bitumen is a semi-solid material consisting of a mixture of hydrocarbons with increasing molecular weight and heteroatom functionalities. If bitumen is dissolved in hydrocarbons such as n-heptane, a precipitate known as asphaltene forms. This is the most complex component of crude oil, consisting of large PAHs. It has been shown that asphaltenes are soluble in toluene but insoluble in n-heptane at reasonable temperatures, which indicates that it is possible to form bituminous solutions. Solubilities of tar sand bitumen in $scCO_2$ have been reported at temperatures between 84° C. and 120° C. These studies reveal that its solubility is temperature- and pressure-dependent, with low temperatures and higher pressures giving optimum solubilities.

Supercritical Fluid Reaction Media

In addition to their excellent extraction properties, supercritical fluids have developed recently into unique and valuable reaction media, and now occupy an important role in synthetic chemistry and industry. They combine the most desirable properties of a liquid with those of a gas. These include the ability to dissolve solids and total miscibility with permanent gases. This is particularly valuable in the case of hydrogen, whose low solubility in conventional solvents is a major obstacle to synthetic chemists. For example, $scCO_2$ with 50 bar of added $H_2$ at 50° C. is 3 M in $H_2$, a concentration that cannot be reached in liquid benzene except at an $H_2$ pressure of 1000 bar.

Two US patents describe the application of SCFs to the upgrading and cracking of heavy hydrocarbons. U.S. Pat. No. 4,483,761 describes the addition of light olefins to an SCF solution, and U.S. Pat. No. 5,496,464 describes the hydrotreating of such a solution.

Carbon Dioxide, $CO_2$

With its low $T_c$, $P_c$, and cost, $CO_2$ has found many applications as a SCF medium for a range of processes. It is already established as an excellent extraction medium, and has demonstrated utility in the extraction of bituminous materials from tar sands and oil shale, as described above. The low $T_c$ for $CO_2$ means that an effective operating range for this medium will be 50-150° C. This is significantly lower than the temperatures required for thermal cracking of PAHs and asphaltenes into smaller volatile fractions, but significant advantage may be gained by a pre-hydrogenation step, as this will furnish a hydrogen-enriched substrate that will provide increased yields of upgraded materials in any subsequent cracking stage. PAHs like anthracene, phenanthrene, pyrene and perylene have been shown to be surprisingly soluble in $scCO_2$, and the fluid is an excellent hydrogenation medium. There is extensive literature on catalyzed organic hydrogenation reactions in $scCO_2$. Of specific interest is research carried out on highly unsaturated and aromatic substrates such as naphthalene and anthracene. Simple PAHs such as naphthalene, anthracene, pyrene and phenanthrene have been successfully hydrogenated to the corresponding hydrocarbon in conventional solvents using homogeneous metal carbonyl catalysts like $Mn_2(CO)_8(PBu_3)_2$, and $RuH_2(H_2)(PCy_3)_2$, although homogeneous hydrogenations usually require severe reaction conditions and are not widely reported. Heterogeneous conditions using a range of transition metal systems, including alumina-supported Pd and Pt, and a reduced $Fe_2O_3$ system are effective hydrogenation catalysts at reasonably low temperatures (<100° C.). Both naphthalene and anthracene have been hydrogenated with a supported Ru catalyst, and anthracene has been upgraded in this way using an active carbon-supported Ni catalyst. Of particular interest in this regard is a recent report describing the facile hydrogenation of naphthalene in $scCO_2$ in the presence of a supported Rh catalyst in 100% yield at the low temperature of 60° C. Homogeneous hydrogenation of heteroaromatic molecules such as benzothiophene (S containing) and indole (N containing) has been successfully demonstrated with a variety of simple catalysts at reasonable temperatures (<100° C.), with no poisoning of the catalysts by the heteroatom components. Photolysis of benzo[α]pyrene, chrysene and fluorene has been carried out in a water/ethanol mixture in the presence of oxygen to form a variety of ring opening products. There are few reports of photochemical transformations carried out in SCFs; however the transparency of $CO_2$ across much of the UV region of the spectrum allows substitution of ethanol with $scCO_2$ while still achieving similar photolysis results with PAHs in this medium. Other catalysts of interest can comprise one or more of Ni, Mo, W, and other transition metals, or mixtures thereof.

Hexane, $C_6H_{14}$

Hexane offers an intermediate operating range (ca. 250-350° C.). Supercritical propane has been demonstrated as a direct extraction technology, and the recovery of bitumen from mined tar sands using a light hydrocarbon liquid is a patented technology. In the temperature regime of $scC_6H_{14}$, thermal rearrangement of the carbon skeleton becomes accessible. For example, alumina-supported noble metal catalysts have been used in the ring-opening of naphthalene and methylcyclohexane at 350° C., and substantial isomerization of the ring-opened products was observed. Homogeneous rhodium-catalyzed ring opening and hydrodesulfurization of benzothiophene has been shown to be successful at 160° C. with relatively low pressures of hydrogen (30 bar) in acetone and THF. The high concentrations of $H_2$ that can be supported in the SCF medium, in tandem with a heterogeneous hydrogenation co-catalyst (q.v.), is likely to result in simultaneous hydrogenation of ring-opened intermediates and their isomers, breaking up the high molecular weight unsaturated aromatic molecules and turning them into volatile aliphatic materials.

Water, $H_2O$

Supercritical $H_2O(scH_2O)$ has found utility in promoting a wide range of organic reactions, including hydrogenation and dehydrogenation; C—C bond formation and breaking; hydrolysis; and oxidation. Hydrogenation of simple PAHs and heteroaromatic hydrocarbons in the presence of sulfur-pretreated $NiMo/Al_2O_3$ catalysts has been demonstrated in $scH_2O$ at 400° C. This medium possesses properties very different from those of ambient-temperature water, including a decreased dielectric constant, a diminished degree of hydrogen bonding and an enhanced (by three orders of magnitude) dissociation constant. Accordingly, many organic compounds are highly soluble in $scH_2O$, and the pure fluid is an excellent environment for acid- and base-catalyzed reactions. $ScH_2O$ has recently been shown to act as an effective medium for the gasification of biomass derived from lignin, glucose and cellulose, because at temperatures around 400° C. major degradation and reorganization of the carbon skeleton occurs. Thus, pyrolysis in the presence of high amounts of dissolved $H_2$ and a Ni or Ru catalyst leads to a range of volatile products such as CO, $CO_2$ and $CH_4$. This represents a significant improvement over conventional gasification procedures, which operate at 700-1000° C. Hydrogenations of simple PAHs and heteroaromatic hydrocarbons in the presence of sulfur pretreated $NiMo/Al_2O_3$ catalysts have also been shown to be successful in $scH_2O$ at 400° C.

In principle, carbon dioxide, hexane and water as supercritical fluid reaction media are capable of integration with an extraction technology: $scCO_2$ has been demonstrated as an effective medium for the extraction of bitumen from tar sand and oil shale deposits; sc propane has been used to extract bitumen from oil sands, and the outflow from current CSS, SAGD or VAPEX extraction technologies may be easily converted into a supercritical bitumen-water mixture. Use of $scH_2O$ appears to be unexplored in tar sands technologies.

Catalysts

The enhanced miscibility of $H_2$ with $scCO_2$ has found a wide range of applications in homogeneous catalysis, including enantioselective preparation of fine chemicals like the herbicide (S)-metolaclor by Novartis. Facile hydroformylation of propene using a $Co_2(CO)_8$ catalyst has also been demonstrated, and an enhanced selectivity for the linear product n-butyraldehyde was observed compared with a conventional liquid solvent. Olefin metathesis, involving the breaking and rearrangement of C=C bonds, has been demonstrated in SCF media under mild conditions. A range of heterogeneous hydrogenation reactions has also been carried out successfully in $scCO_2$ including Fischer-Tropsch synthesis using a $Ru/Al_2O_3$ or a $Co/La/SiO_2$ catalyst system. Heterogeneous Group 8 metal catalysts are also very effective in the synthesis of N,N-dimethylformamide from $CO_2$, $H_2$ and $Me_2NH$ under supercritical conditions, and the hydrogenation of unsaturated ketones using a supported Pd catalyst has been carried out under mild conditions in $scCO_2$.

Oil, tar or bituminous material from oil sand or oil shale deposits can be extracted using a supercritical or near-critical solvent. The solubility of bitumen in supercritical $CO_2$ and supercritical hexane can be increased, and subsequently its extraction from tar sands can be enhanced by adding modifiers such as toluene or methanol and by using sonication to encourage dissolution. Sonication has recently been claimed to accelerate chemical reactions in a supercritical fluid medium.

In one embodiment of the invention, carbon dioxide is used as a supercritical medium for the combined extraction and upgrading process. Carbon dioxide has the most accessible critical temperature and is cheap, but lacks polarity and will be limited to a low temperature upgrading process. Modifiers such as toluene or methanol can be added to help dissolve bituminous material.

In another embodiment of this invention, hexane is used as a supercritical medium for the combined extraction and upgrading process. It offers a medium temperature possibility, but also suffers from the lack of a dipole moment and is the most costly of the three medium.

In another embodiment of this invention, water is used as a supercritical medium for the combined extraction and upgrading process. Water has the highest critical temperature. The polar nature and negligible cost of water are attractive characteristics.

An appropriate amount of hydrogen gas is introduced into this supercritical or near-critical mixture. The appropriate amount of hydrogen gas will vary according to the amount of unsaturation present in the hydrocarbon to be upgraded, and in relation to the proportion of hydrogen that is desired to be maintained in the reaction medium.

Hydrogenation and ring-opening reactions of simple PAHs like naphthalene and anthracene, and of more complex PAHs, including mixtures of PAHs containing heteroatoms like N and S, and transition metals, are conducted in these SCF media using a wide range of catalysts. Such mixtures are representative of the chemical constitution of bitumen and shale oil.

A number homogeneous and heterogeneous catalysts may be used with PAH substrates for a combination of hydrogenation and ring opening reactions in $scC_6H_{14}$, and cleavage, hydrogenation and gasification in $scH_2O$. These homogeneous catalysts include Nb and Ta, which have been shown to be effective for the hydrogenation of a variety of arene substrates. Heterogeneous supported systems are likely to prove more robust and long-lived than homogeneous catalysts. For $scCO_2$, there is a wide range of commercially available hydrogenation catalysts including heterogeneous Ni and Ru systems supported on alumina or carbon, and metals like Rh and Pt that can be costly.

Small amounts of co-solvents like n-butane and methanol can also be added to the $scCO_2$ medium to enhance the solubility of PAHs in $scCO_2$.

The reaction mixture can be activated by photochemical irradiation using light in the ultraviolet and/or visible region of the electromagnetic spectrum. This activation can be used to accelerate the ring-opening, fragmentation and hydrogenation reactions involved in the upgrading process.

Only the most robust catalysts will be compatible with the reactive and/or high temperature environment in $scC_6H_{14}$ and $scH_2O$. However, $\alpha$-$Al_2O_3$, $HfO_2$ and $ZrO_2$ are all physically and chemically stable under these conditions, and can be used to support finely divided metal catalysts. Late transition metals like Fe, Ni, Ru, Rh, Pd and Pt are effective hydrogen transfer catalysts to unsaturated organic moieties including the aromatic rings of PAHs, whereas Ru and Ir are known to be good catalysts for ring-opening and olefin metathesis.

Development of an optimal heterogeneous supported catalyst that combines these two processes under supercritical conditions is an iterative process necessitating a combinatorial approach at the outset. However, the simple expedient of e.g. impregnating $Al_2O_3$ with stock solutions of metal salts, followed by drying and reduction with $H_2$ gas is remarkably effective in producing high activity catalysts for these types of processes.

The reaction mixture is maintained at an appropriate temperature for an appropriate length of time to effect the desired hydrogenation, rearrangement, or degradation of the bituminous material in the mixture. The required temperature and length of time will vary depending on the concentration of reagents in the system and the quantity of material that one wishes to upgrade.

Materials and Methods

Bitumen Upgrading

Commercially available naphthalene, anthracene, phenanthrene, pyrene, Rh and Pd supported catalysts (charcoal and alumina 5%) were obtained from Sigma Aldrich. All materials were used without further purification.

Typical experimental procedure: A 20 mL pressure vessel was charged with substrate (0.84 mmol) and catalyst (50 mg) and a stirrer bar. The vessel was attached to a high pressure system and heated to the desired temperature. $H_2$ (6.2 MPa) was introduced into the vessel, then $CO_2$ (10 MPa) was added via syringe pump and the reaction mixture was stirred for the designated time, after which the vessel was cooled to room temperature. The gases were vented through an ether trap and the catalyst was separated by filtration. The contents of the vessel were extracted with $Et_2O$, and the resulting solution was filtered to separate catalyst from the products. The reaction products were analysed quantitatively using GC-MS analysis (Agilent 7890A and 5975MSD).

The following examples are intended to be illustrative of embodiments of the present invention. Those of skill in the art may effect alterations, modifications and variations to the particular embodiments without departing from the scope of the invention, which is set forth in the claims.

Example #1

Hydrogenation of naphthalene, a PAH, was carried out in the presence of Rh/C with $H_2$ (60 bar, 870 psi) and $scCO_2$ (100 bar, 1450 psi). Reactions were carried out for 16 hours according to the reaction conditions shown in FIG. 4.

Figure 2:
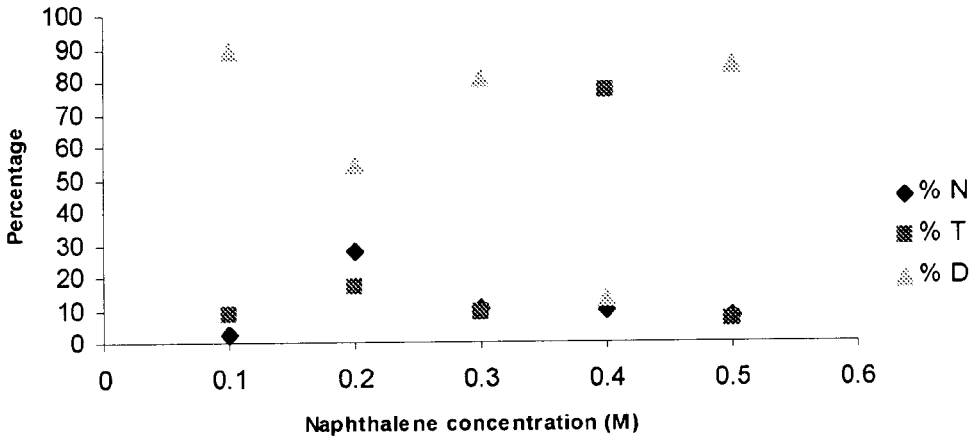
FIG. 2 is a graph showing hydrogenation of naphthalene as a function of initial concentration of naphthalene according to one embodiment of the invention.

FIG. 2 is a graph showing hydrogenation of naphthalene as a function of initial concentration of naphthalene, in which the amount of naphthalene is indicated by diamonds, the amount of tetralin is indicated by squares, and the amount of decalin is indicated by triangles. The vertical axis represents relative concentration of hydrocarbon in percent total hydrocarbon, and the horizontal axis represents initial concentration of naphthalene in moles.

The reaction was repeated using naphthalene concentrations of 0.1 M, 0.2 M, 0.3 M, 0.4 M, and 0.5 M. Under these reaction conditions, total hydrogenation of naphthalene was achieved at concentrations greater than 0.1 M. The result at 0.4 M is possibly due to errors associated with new equipment.

Example #2

Figure 3:
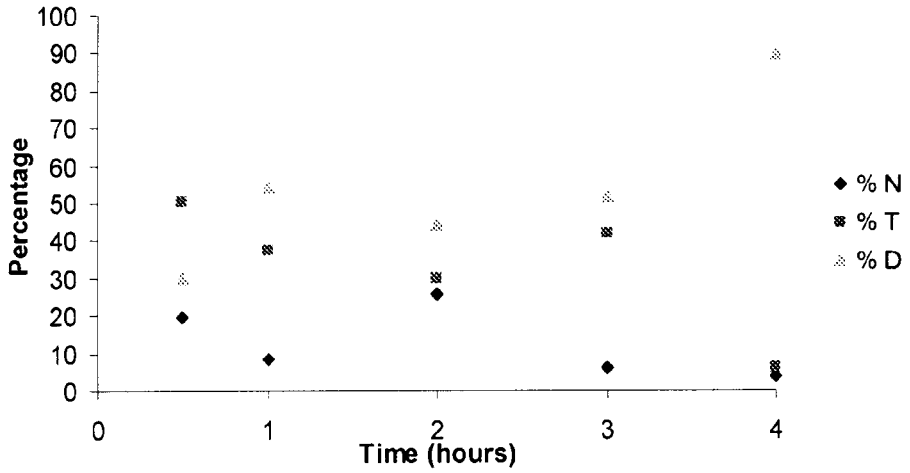
FIG. 3 is a graph showing the hydrogenation of naphthalene as a function of time in $scCO_2$ (10 MPa) according to one embodiment of the invention.

Hydrogenation of naphthalene, a PAH, was carried out by mixing 0.1 M naphthalene in the presence of Rh/C with $H_2$ (60 bar, 870 psi) and $scCO_2$ (100 bar, 1450 psi) at 60° C. The percentage of tetralin and decalin formed was analyzed at 30 minutes, 1 hour, 2 hours, 3 hours and 4 hours. FIG. 3 is a graph showing the hydrogenation of naphthalene as a function of time, in which the amount of naphthalene is indicated by diamonds, the amount of tetralin is indicated by squares, and the amount of decalin is indicated by triangles. The vertical axis represents relative concentration of hydrocarbon in percent total hydrocarbon, and the horizontal axis represents duration of the reaction process in units of hours.

As indicated in FIG. 3, 80% of naphthalene was converted to tetralin (50%) and decal in (30%) within 30 minutes. As the reaction time increased, naphthalene decreased further and formations of products increased. After 4 hours 90% of naphthalene had been converted to fully saturated decalin. Therefore, it is believed that only about 4 hours is required for complete hydrogenation, rather than 16 hours.

Figure 4:
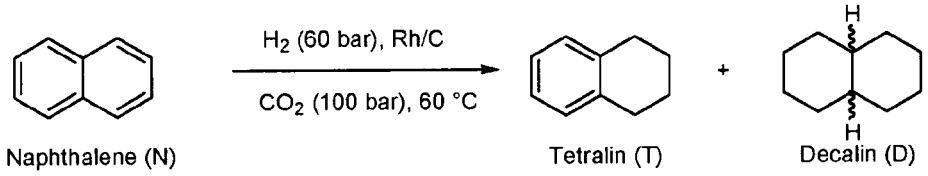
FIG. 4 is a diagram illustrating the conversion of naphthalene to tetralin and decalin.

Naphthalene: Reactions were carried out at 60° C. for up to four hours using Rh/C (50 mg) and H2 (6.2 MPa) in $scCO_2$ (10 MPa) (FIG. 4, FIG. 3).

The results of the reaction determined the repeatability of previous literature findings, with complete hydrogenation within 4 hours in $scCO_2$. Naphthalene was converted to a mixture of tetralin and decalin within one hour, with longer reaction times leading to fully hydrogenated products. Reactions in n-heptane were also shown to go to completion within four hours using identical reaction conditions (99.6% conversion, 95.2% decalin).

Figure 7:
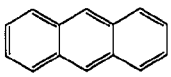
FIG. 7 is a diagram illustrating the structure of anthracene.
Figure 8:
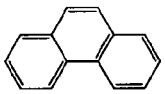
FIG. 8 is a diagram illustrating the structure of phenanthrene.
Figure 9:
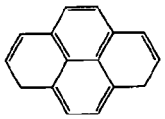
FIG. 9 is a diagram illustrating the structure of pyrene.

The investigation was extended to hydrogenation of other simple PAHs with tri- and tetracyclic ring systems, as shown in FIG. 7, FIG. 8 and FIG. 9. The results are summarized in FIG. 5 and FIG. 6.

Anthracene

Figure 5:
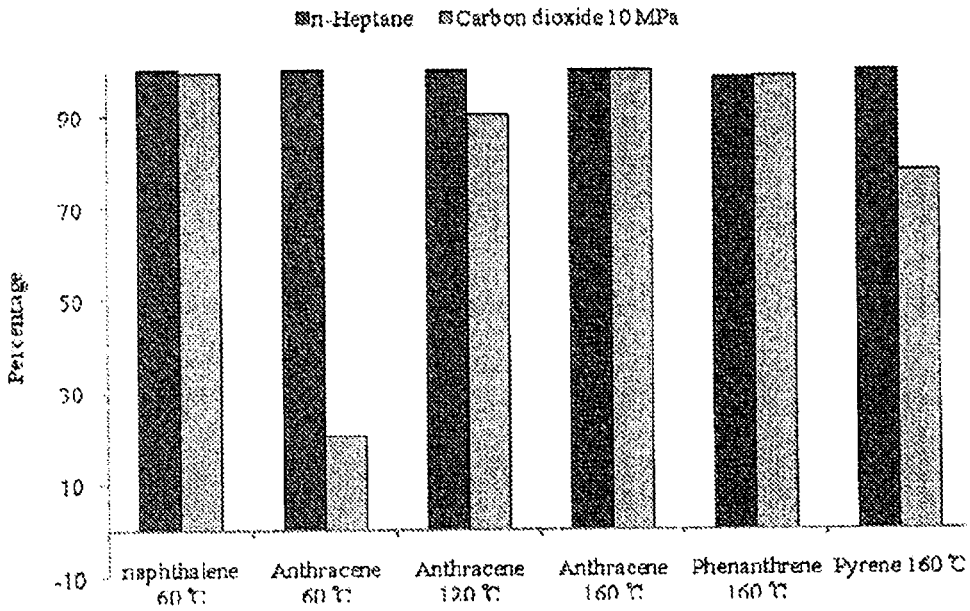
FIG. 5 is a diagram illustrating the conversion of PAHs to products in n-heptane and $scCO_2$ (10 MPa).
Figure 6:
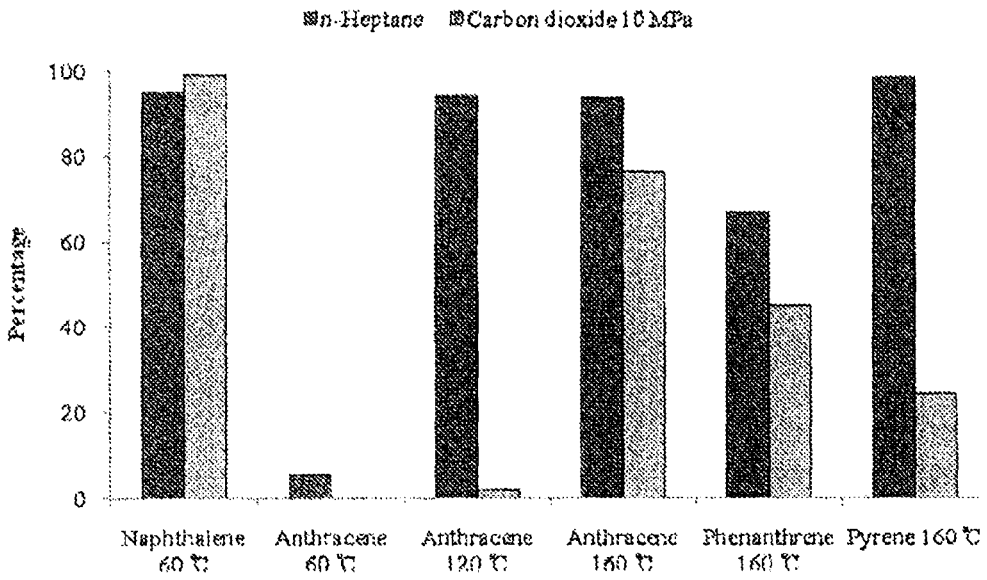
FIG. 6 is a diagram illustrating the conversion to fully hydrogenated materials in n-heptane and $scCO_2$ (10 MPa).

Hydrogenation of anthracene (0.84 mmol) in n-heptane proceeded to the fully hydrogenated product perhydroanthracene in 4 h at 120° C. Lower temperatures (60-100° C.) resulted in a mixture of partially hydrogenated materials, with <5% of the perhydro product. In scCO2 (10 MPa) lower temperatures (60-80° C.) were found to give poor conversions « 50%); however higher yields (up to 100%) were obtained at higher temperatures (100-160° C.) over a period of 16 h (FIG. 5). Although high conversions of anthracene to a mixture of partially and fully hydrogenated materials were observed, only low amounts (17%) of perhydroanthracene were obtained. The yield of fully hydrogenated product in $scCO_2$ improved to 77% within 4 h by raising the $H_2$ pressure to 12.4 MPa (FIG. 6).

Phenanthrene

Hydrogenation of phenanthrene proved to be significantly more difficult than anthracene. In order to overcome low reaction rates, a higher reaction temperature (160° C.) was employed. Low conversions were obtained in n-heptane at higher substrate concentrations (39%; 0.84 mmol). Higher conversions were obtained in scCO2 at the same substrate concentration (45%). The dependence of the reaction rate on concentration was explored in n-heptane (0.4-0.84 mmol), which established that the reaction proceeds fastest at lower concentrations, with almost quantitative conversion (97%, 0.14 mmol) to the fully hydrogenated perhydrophenanthrene (FIG. 6).

Figure 10:
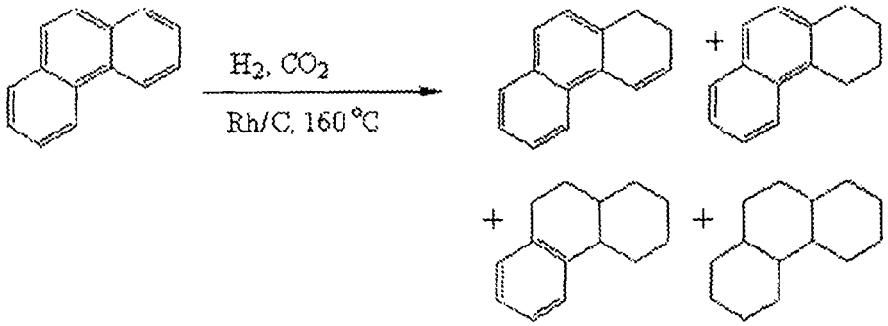
FIG. 10 is a diagram illustrating the reaction scheme for the hydrogenation of phenanthrene.

The hydrogenation of phenanthrene catalyzed by rhodium supported on carbon (Rh/C) in supercritical carbon dioxide ($scCO_2$) has been studied. Our results show that at 1:1 catalyst-to substrate ratio it is difficult to obtain complete conversion of phenanthrene to hydrogenated products. An increase in catalyst to a 2:1 ratio showed almost quantitative conversion to hydrogenated products, with a slight increase in hydrogen pressure from 1300 psi to 1500 psi. The fully hydrogenated product, perhydrophenanthrene, was obtained in equilibrium with other products at 46% in four hours. See FIG. 10

In addition to heterogeneous hydrogenation catalysts, there are many well-known homogeneous hydrogenation catalyst systems: however, these are generally only effective for the hydrogenation of olefins. There are only a few homogeneous catalysts that demonstrate the ability to catalyze the hydrogenation of aromatic substrates. Some middle and later transition metal complexes have demonstrated the ability to hydrogenate aromatic rings, but there is some ambiguity as to whether the active species are truly homogeneous. On the other hand, a series of group 5 hydrido complexes featuring aryloxide ligands has been developed; these have demonstrated the ability to hydrogenate naphthalene, anthracene and phenanthrene in good yield in cyclohexane at 80° C. and 1200 psi of $H_2$. We have synthesized [Ta($OC_6H_3$—$Pr^i_2$-2,6)$_2$(Cl)(H)$_2$(PPhMe$_2$)$_2$] and tested its ability to hydrogenate phenanthrene for comparison with the results obtained for the homogeneous hydrogenation by supported Rh/C in $scCO_2$.

Methods and Materials

Supercritical reactions were carried out in a 25 mL stainless steel reactor. The substrate (phenanthrene; 98%), and the supported catalyst, (Rh, 5 wt % (dry) on carbon, wet; Degussa type G 1 06B/W, reduced), was obtained from Aldrich. The reactor was charged with the substrate and catalyst, and the vessel was heated to the desired temperature at which point $H_2$ gas was added. The reactor was then pressurized with $CO_2$. Products were isolated by filtration and analyzed by a 7890A Agilent gas chromatograph in tandem with a 5975C mass spectrometer (GC/MS).

Results

Results of the hydrogenation reactions using Rh/C in $scCO_2$ are presented in TABLE I. TABLE I lists parameters of the hetergeneous hydrogenation of phenanthrene using Rh/C at varying times and $H_2$ pressure in $scCO_2$ at 160° C. It is evident from TABLE I that the catalyst-to-substrate ratio plays a crucial role in the yield of hydrogenated products. Reactions 5, 6, 7 and 8 were performed for 2, 4, 8 and 16 h; respectively, using a 2:1 (w/w) catalyst-to-substrate ratio and 1500 psi of $H_2$ gas. Conversion to hydrogenated products in $scCO_2$ was >97%, with significant yields of the fully hydrogenated perhydrophenanthrene being observed. At 1:1 ratios (reactions 1, 2, 3 and 4) a lower hydrogen pressure led to higher yields of products; however the fully hydrogenated product was not observed under these conditions.

Figure 11:
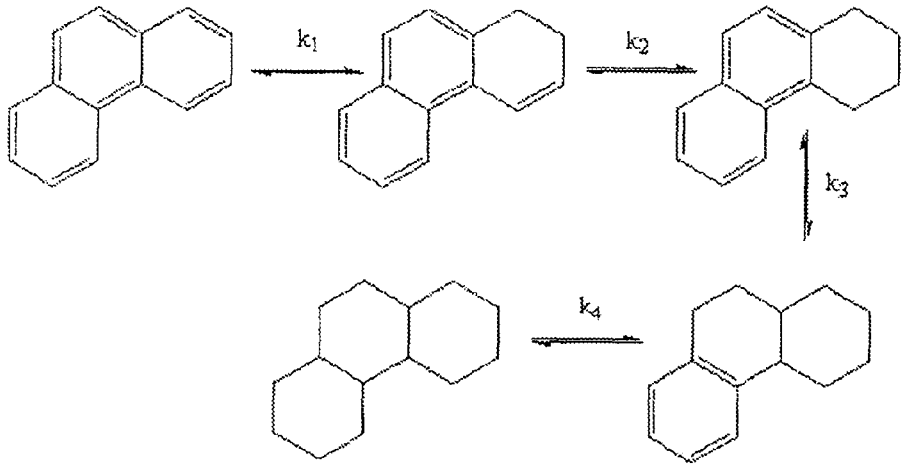
FIG. 11 is a diagram illustrating the equilibrium between phenanthrene starting material and the formation of products during hydrogenation.

The results in TABLE I reveal a time dependence that implies the existence of an equilibrium controlling the formation of hydrogenated products (FIG. 11). It has been previously reported that hydrogenation reactions of PAHs are reversible and exothermic, and complete conversion is often not feasible because of thermodynamic equilibrium limitations. Reactions 5, 6, 7 and 8 were carried out for periods between 2 and 16 h, and near-quantitative conversion to products was observed with the exception of 8; however, after 4 h the highest proportion of fully hydrogenated perhydrophenanthrene was observed.

Pyrene

The hydrogenation of pyrene in conventional solvents has not been widely explored, although two reports document low conversion to perhydropyrene. Drawing on our successes with other PAHs, pyrene was hydrogenated in n-heptane and scCO2, using Rh/C at 160° C. A concentration study (0.12-0.74 mmol pyrene) revealed that lower concentrations of substrate (0.24 mmol) were converted quantitatively to perhydropyrene within 16 h at 160° C. in nheptane using a Rh/C catalyst and 6.2 MPa H2 (FIGS. 2 and 3). Experiments have been conducted on pyrene in scCO2: (0.24 mmol) was transformed into hydrogenated products in 78% yield in the presence of Rh/C (50 mg) and H2 (6.2 MPa) within 4 h at 160° C. (FIG. 5 and FIG. 6).

Another aspect of this project is concerned with solubility and upgrading of actual bitumen samples from the oil sands in Alberta. Solubilities of tar sand bitumen in scCO2 have been reported at temperatures between 84 and 120° C. These studies reveal that its solubility is temperature- and pressure-dependent, with low temperatures and higher pressures giving optimal solubilities. It has also been show that asphaltenes, a heavier constituent of bitumen, are soluble in toluene but insoluble in n-heptane at reasonable temperatures, which indicates that it is possible to form bituminous solutions A comparison of results that we have obtained with prior investigations reported in the literature appears in TABLE II.

Ring-Opening Reactions

Hydrogenolysis of hetero-polyaromatic hydrocarbons (HPH) using an environmentally benign solvent; viz. supercritical carbon dioxide (scCO2) is now described. Reactions were carried out on model substrates using a variety of commercially available or synthesized heterogeneous catalysts. Substrates investigated include quinoline, indole, benzothiophene and 2-(2-pyridyl)benzothiophene. Optimization of $H_2$:$CO_2$ ratios resulted in high levels of hydrodesulfurization (HDS) and hydrodenitrogenation (HDN), and to fully or partially hydrogenated products, some of which exhibit ring opening.

The hydrotreatment of HPHs is not trivial, and generally requires forcing reaction temperatures (300+° C.) and high $H_2$ pressures (>10 MPa) to obtain low levels of conversion to fully hydrogenated materials. 5 Conventional HDS/HDN reactions are performed at higher temperatures (350+° C.), and utilize the toxic sulfiding agent $H_2S$. HDS and HDN reactions of these types of molecules are of great importance to the petroleum industry, and have been the subject of many studies over the last two decades. The beneficial combination of Canadian oil sands and American coal deposits provides an essential component to North American energy self sufficiency and security. Successful upgrading of bitumen into synthetic crude oil and the clean conversion of coal to liquid fuel sources (methanol, ammonia and diesel), will offer North America capabilities to be self-sufficient in energy without unacceptably polluting the environment. To achieve energy sustainability that satisfies current and impending environmental regulations of sulfur and nitrogen levels in transportation fuel, a clean conversion technology and methodology is fundamental. The main objective of this project is to explore the utility of $scCO_2$ for upgrading and hydrotreatment of oil sand and coal. Sc $CO_2$ has the potential to play several roles in bitumen upgrading and the advancement of clean coal technologies; these include bitumen extraction and the drying of coal using $scCO_2$, as well as its use as a reaction medium for catalytic hydrogenolysis and hydrogenation. We describe the hydrogenation and ring-opening of quinoline, indole, benzothiophene and 2-(2-pyridyl)benzothiophene in $scCO_2$ under remarkably mild conditions, and compare this to reaction using conventional solvents.

Materials and Methods

Typical experimental procedure: A 20 mL high-pressure vessel was charged with substrate (0.84 mmol) and catalyst (50 mg), and equipped with a magnetic stirrer bar. The vessel was attached to a high-pressure manifold and heated to the desired temperature. $H_2$ (7.2-18.9 MPa) was added to the vessel, followed by $CO_2$ (8.6 MPa-10.3 MPa) via syringe pump. The vessel was sealed and the reaction was stirred for the desired period, after which the vessel was allowed to cool to room temperature. The gases were vented through a concentrated NaOH trap and the catalyst was separated via simple filtration. The contents of the vessel were washed with hexane and the resulting solution was filtered to separate the catalyst from the products. The reaction products were identified quantitatively using GC-MS analysis (Agilent 7890A and 5975MSD).

CoMoS4/TiO2-$Al_2O_3$ was synthesised via a urea matrix combustion method. A mixture of $CO(NO_3)_2.6H_2O$ (0.34 mmol), $(NH_4)_2MoS_4$ (1.65 mmol), urea (19.94 mmol), and distilled water (7.5 mL) was stirred at room temperature to form a homogeneous slurry. Once homogeneity was achieved, a ball-milled mixture of 95 wt % $TiO_2$ (47.63 mmol) and 5 wt % $\gamma$-$Al_2O_3$ (1.48 mmol) was added and the mixture was heated to 50° C. for 3 h. This paste was ignited at 500° C. (Lindberg Hevi-Duty furnace temperature) in static air for 10 min, to produce blue-tinted black powder.

The synthesis of $NiMoW/Al_2O_3$ was carried out by a wetness co-impregnation method. A mixture of $NiNO_3.6H_2O$ (0.89 mmol), $\gamma$-$Al_2O_3$ (50.15 mmol), and distilled water (7.5 mL) was stirred for 16 h at room temperature in a round-bottom flask. Another mixture that contained $(NH_4)6Mo_7O_{24}.4H_2O$ (1.00 mmol), $(NH_4)_{10}H_2(W_2O_7)_6$ (0.25 mmol), and methanol (7.5 ml) was stirred for 16 h at room temperature. The two mixtures were combined and calcined at 500° C. (Lindberg Hevi-Duty furnace temperature) in static air for 8 h, yielding a fine black powder.

Results

Figure 12:
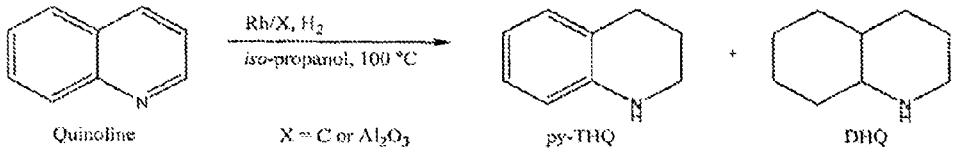
FIG. 12 is a diagram illustrating the hydrogenation of a ring compound comprising nitrogen.

Vaccari et al. demonstrated that quinoline could be partially hydrogenated to 1,2,3,4-tetrahydroquinoline (py-THQ) in iso-propanol in the presence of $Rh/Al_2O_3$ and $H_2$ (2.0 MPa). In order to obtain full conversion to DHQ, another aliquot of catalyst was added once the reaction had terminated, as the authors believed that the intermediate was poisoning the catalyst. We repeated this reaction, but without addition of the second aliquot of catalyst. Higher $H_2$ pressures were also investigated (FIG. 12). Quinoline (1.16 mmol) was hydrogenated in iso-propanol (15 mL) with $Rh/Al_2O_3$ or Rh/C (50 mg). The reactions were carried out at 100° C., and the results are shown in TABLE III.

These results demonstrated that DHQ can be obtained with high conversions within only 2 h using higher $H_2$ pressures (10.8 MPa); this is a significant improvement on the literature precedent. Reactions carried out in $scCO_2$ resulted in only the partially hydrogenated product being formed. See TABLE IV. Although high conversions were obtained in scCO2, only small amounts of DHQ were observed.

Model Compounds for HDS and HDN in scCO2

Figure 13:
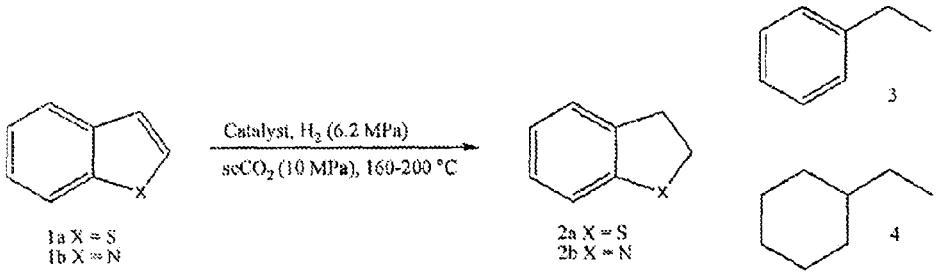
FIG. 13 is a diagram illustrating hydrogenation and ring opening reactions of a ring compound comprising nitrogen or sulfur.
Figure 22:
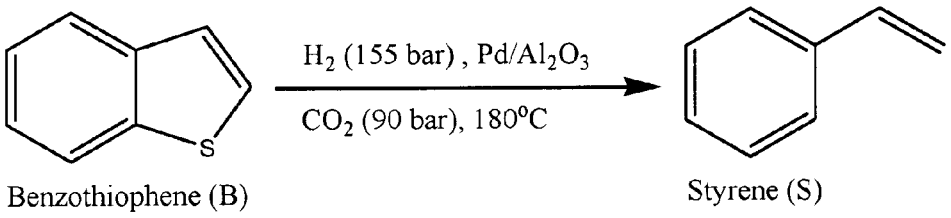
FIG. 22 is a diagram illustrating hydrogenation and ring opening reactions of a ring compound comprising sulfur.
Figure 23:
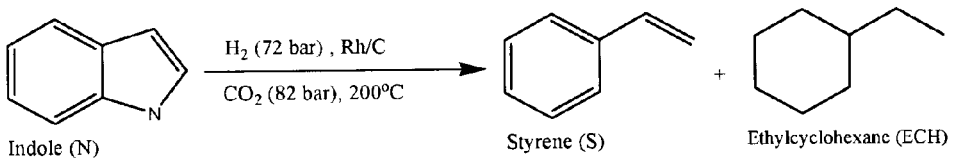
FIG. 23 is a diagram illustrating hydrogenation and ring opening reactions of a ring compound comprising nitrogen.

Benzothiophene HDS and indole HDN reactions were performed in scCO2 using various heterogeneous catalysts (FIG. 13). The results in scCO2 are shown in TABLE V; reactions were also carried out in hexane for comparison. See TABLE VI. For benzothiophene, HDS products were predominant using $Pd/Al_2O_3$, whereas the hydrogenation pathway was observed when using $Rh/Al_2O_3$. The major product was the partially hydrogenated HPH. See FIG. 22. Indole HDN proved to be more difficult to achieve using commercial and in-house-synthesized catalysts, but encouraging results were obtained at lower hydrogen pressures. See FIG. 23. Reactions were performed over the temperature range of 100-225° C., with the optimal HDN temperature being 200° C. The fully hydrogenated product (4) was observed in $scCO_2$ only with the commercial catalysts; however no such product was observed when using hexane as the reaction medium.

Combined HDS/HDN in scCO2

Figure 14:
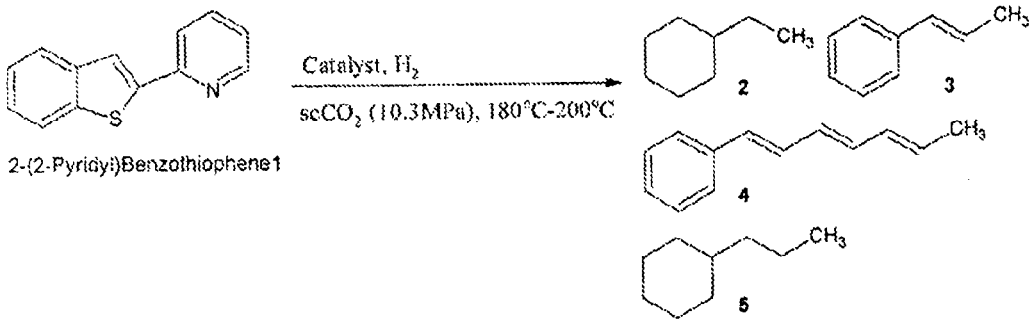
FIG. 14 is a diagram illustrating hydrogenation and ring opening reactions of a ring compound comprising both nitrogen and sulfur.

Due to the success achieved with other HPHs in $scCO_2$, 2-(2-pyridyl)benzothiophene was chosen as an example of a substrate containing both N and S functionalities (FIG. 14). Combined HDS/HDN experiments using far lower temperatures and $(NH_4)_2S_2O_3$ as the sulfiding agent were performed. These reactions showed high levels of hydro-cracking products, with the major one being ethylcyclohexane. See TABLE VI. Up to 76% ethylcyclohexane was observed; an unprecedentedly high yield. In this case, the synthesised catalyst performed equally as well as the commercial catalyst; $CoMoS_4/TiO_2$—$Al_2O_3$ (15 mg) was presulfurised with $(NH_4)_2S_2O_3$ (50 mg/0.34 mmol) by mixing in distilled water (5.0 mL) at 90° C. for 2 h.

Superior HDS and HDN conversions were obtained in scCO2 in comparison to conventional solvents (hexane). The ring-opening results of the model systems are remarkable; up to 79.8% observed for HDS and 39.8% for HDN.

Bitumen and Tar Sand Upgrading

Figure 15:
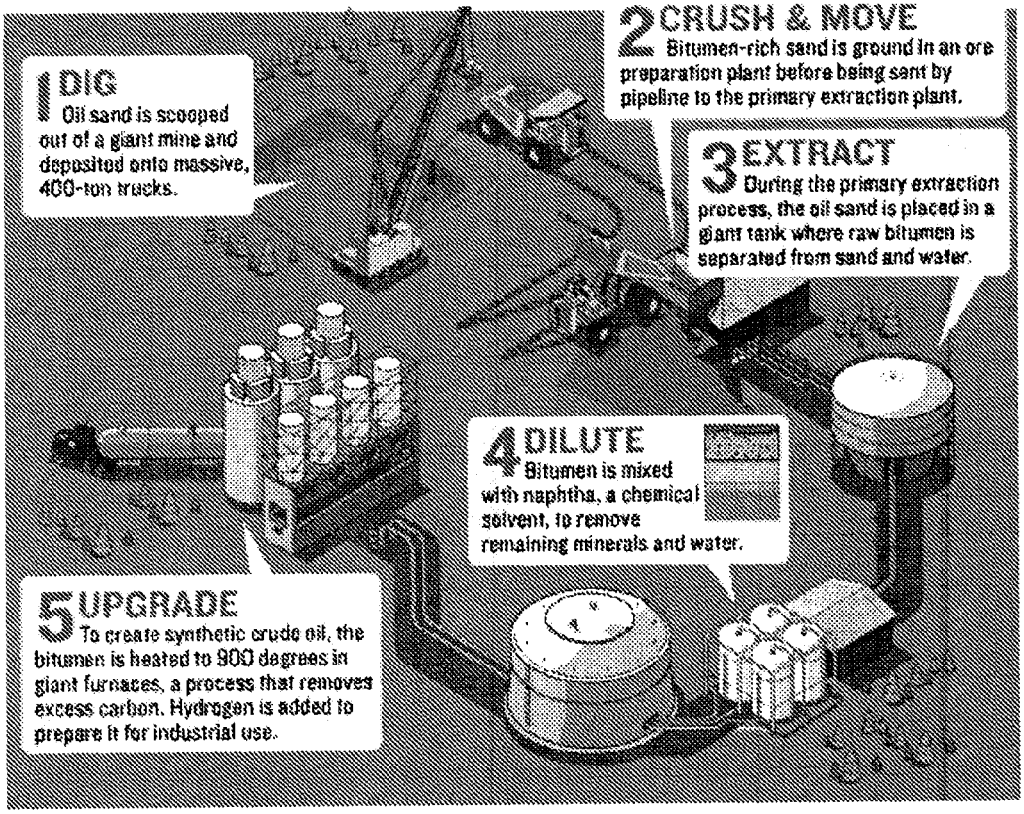
FIG. 15 PRIOR ART
FIG. 15 is a schematic diagram that illustrates the current (prior art) bitumen extraction process.

Current extraction technologies are very time consuming. Extraction can take up to 8 weeks. The current technologies are economically unfavorable, because of high transportation costs and long processing times. In addition the current extraction technologies are detrimental to the environment. There is a net release of approximately 125-175 kg CO2 per barrel of oil that is produced. In addition, large amounts of waste need to be disposed of. The current extraction process is illustrated schematically in FIG. 15. Using the systems and methods described herein, tar sand was extracted using a mixture of toluene and $scCO_2$ at 100° C. and 1450 psi $CO_2$.

Oil sand and catalyst was added to a reaction vessel heated at 100° C. in a $H_2/CO_2$/toluene mixture. After work-up the bitumen was mobilized from a semi-solid to synthetic oil, and its API gravity increased from ~8 to ~16. Sulfur and nitrogen levels were also significantly reduced (S=5.07-1.82% and N=0.51 to <0.3%), a remarkable reduction under such mild conditions.

It is expected that a range of catalysts and varying reaction conditions can be successfully used. It is believed that use of SCFs will allow one to omit or reduce the use of conventional solvents. The SCF can usually be recycled, which is expected to provide a reduction in process costs and reduce its environmental impact. We have employed heterogeneous catalysts in our investigations to date, In addition, this technology can be used to mobilize and upgrade other forms of heavy oils, shale oils, and non-traditional oil sources. The technology is also expected to be applied to enhancing the value of refinery wastes and refinery oil bottoms, or to provide an additional recovery pass at a refinery. In principle, the technology may also be applied to reduce the variability in fuel feedstocks, allowing cross utility of fuel at multiple refineries. The use of SCF mixtures containing hydrogen for the low-temperature catalytic upgrading of bitumen and heavy oils has never been reported before.

Catalytic Upgrading of Bitumen in SCFs at Low to Moderate Temperatures

Bitumen Upgrading in SCFs. There is limited literature precedence for the upgrading of bituminous materials in SCFs. Scott et al. reported successful upgrading of bitumen in a range of supercritical alkanes (>C10) with $H_2$ and various carbon supported catalysts at 1015-1986 psi and 400-450° C. Up to 90% pitch conversion was obtained using $scC_{12}H_{26}$ at +400° C. in the presence of these charcoal catalysts; however, when Co—$Mo/Al_2O_3$ was used the $H_2$ uptake was higher, but the conversion of the pitch into lighter products decreased (71%). Kishita and coworkers reported desulfurization of bitumen by hydrothermal upgrading processes in $scH_2O$ with addition of KOH at 430° C. and 4350 psi $H_2$. Although use of high-temperature SCFs as reaction media for bitumen upgrading has been demonstrated, their advantages are relatively small, and there are much more attractive opportunities using SCFs with lower critical parameters. Supercritical $CO_2$ is also desirable as an upgrading solvent, as it is known that $CO_2$ can permeate into tar sands and promote swelling of the crude, enhancing the total process by mobilizing the substrate prior to chemical reaction.

Figure 16:
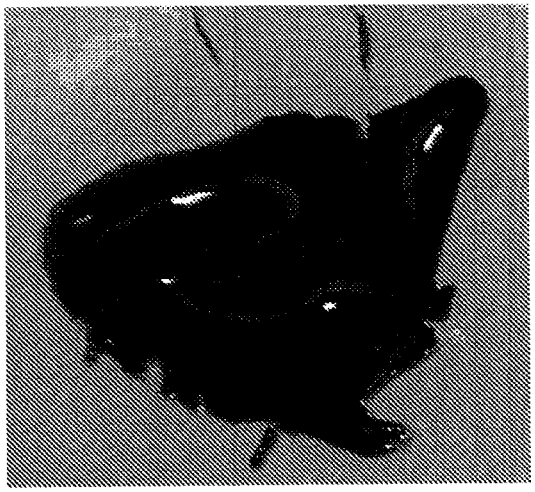
FIG. 16 illustrates a sample of crude bitumen from the Cristina Lake reservoir.
Figure 17:
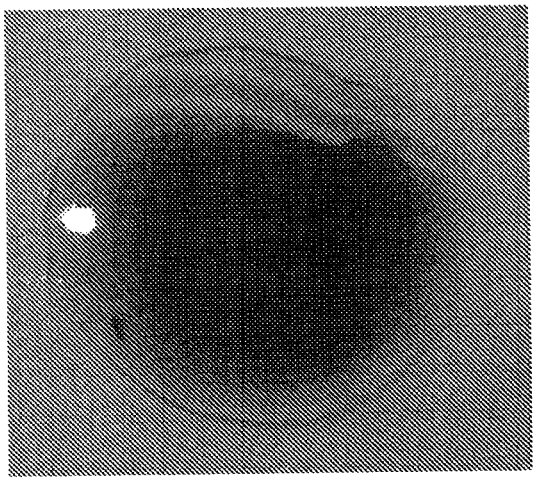
FIG. 17 illustrates an upgraded sample of this material after hydrotreatment with $scCO_2/H_2$ at 100° C.

We expect to reduce energy costs by demonstrating bitumen upgrading in a variety of SCFs at significantly lower temperatures that are currently employed in Alberta. Preliminary experiments conducted by us involved hydrogenation and upgrading of model polycyclic aromatic (PAH) constituents of bitumen like compounds like anthracene and pyrene (50 mL scale) using $scCO_2/H_2$ at temperatures below 200° C. The success of these investigations prompted us to extend the approach to examine the potential of our SCF approach to hydrodesulfurization (HDS) and hydrodenitrogenation (HDN) of a range of petroleum substrates. We extended this investigation to encompass genuine samples of Alberta bitumen. The short-term objective of this technology was to confirm the concept of the research by carrying out catalytic upgrading of bitumen in $H_2/scCO_2$/toluene mixtures at 100° C. using a variety of heterogeneous catalysts. We have unambiguously demonstrated that bitumen, FIG. 16, can be mobilized and significantly upgraded. FIG. 17, in $H_2/CO_2$/toluene (900 psi $H_2$, 1450 psi $CO_2$, 3 mL toluene) mixtures, using noble metal (Rh/C or Ru/C) or base metal (Co/Mo) catalysts at moderate temperatures (100° C.). Under these remarkably mild conditions, the API gravity increased from 7.8 to as high as 17.8. Results of the various experiments are summarized in TABLE VIII.

Figure 18:
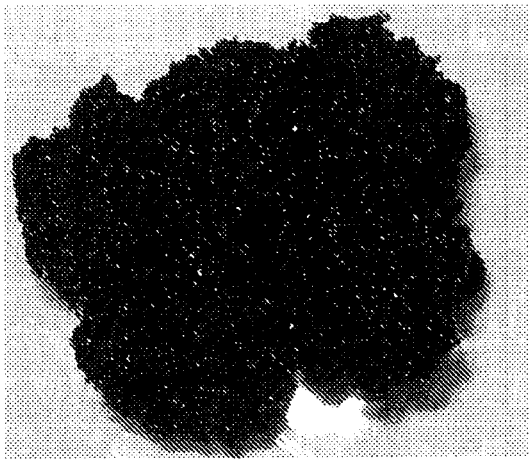
FIG. 18 illustrates a sample of Alberta tar sand.
Figure 19:
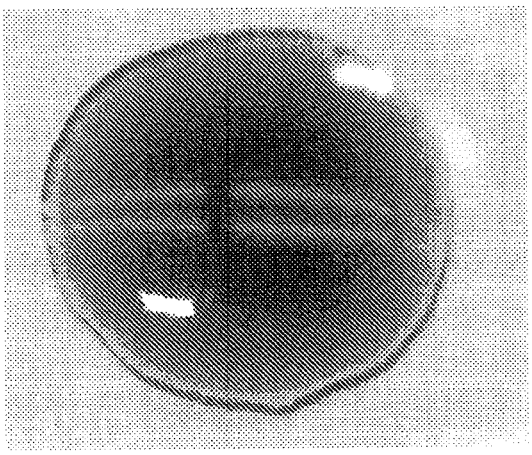
FIG. 19 illustrates an extracted and upgraded material after hydrotreatment with $scCO_2/H_2$ at 100° C.
Figure 20:
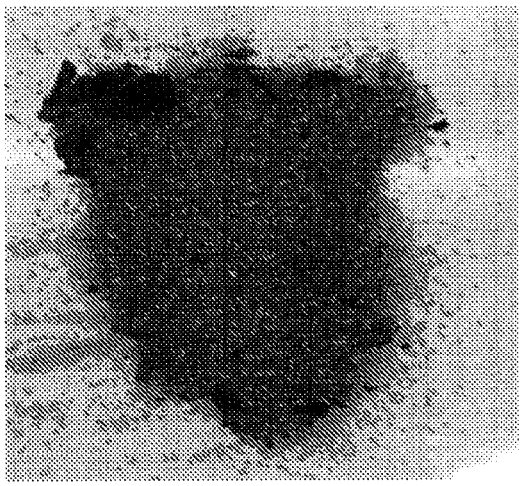
FIG. 20 illustrates a sample of residual sand after extraction and upgrading.
Figure 21:
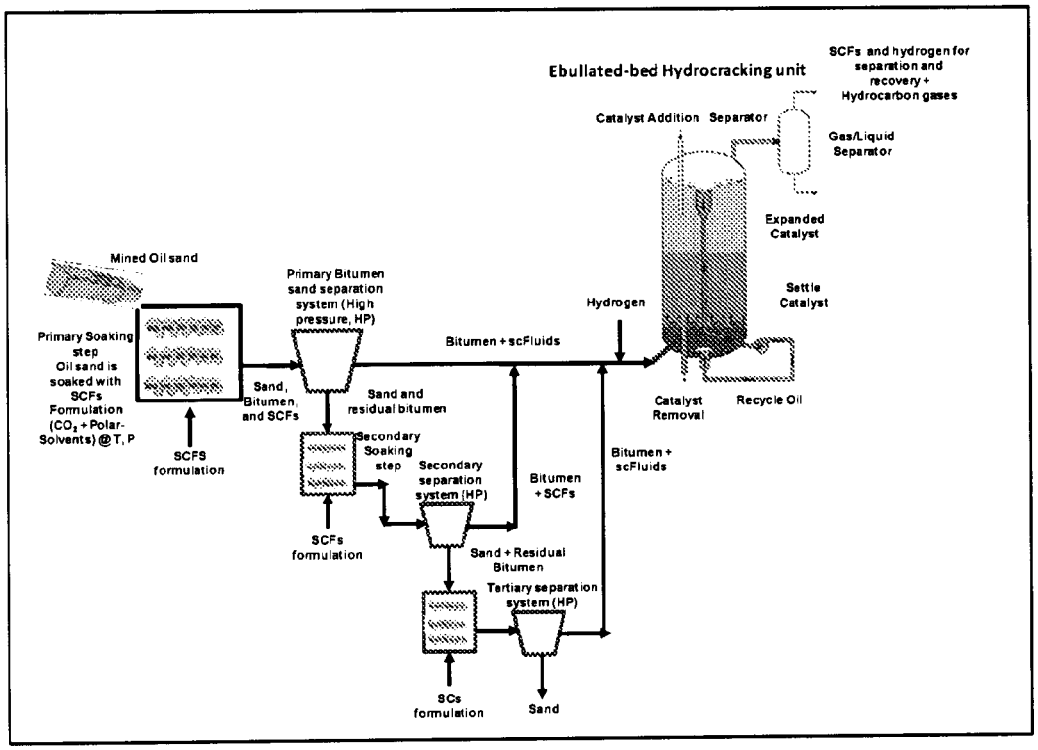
FIG. 21 is a simplified schematic of bitumen extraction and upgrading process using an ebullated-bed reactor.

These results demonstrate clearly the potential advantages of a preliminary SCF treatment of bitumen in this way. The intractable material is mobilized into synthetic crude oil, and levels of S, Ni and V are also significantly lowered. TABLE VIII also lists the results of analogous experiments carried out on samples of Alberta oil sands under identical conditions. In these experiments, the bitumen was recovered from the sand matrix and converted to synthetic crude oil in a single low-temperature stage. FIG. 18-FIG. 19 shows the material before and after treatment in this manner, and clearly demonstrates that it is possible to achieve simultaneous separation of the organic and inorganic components of the tar sand composite along with conversion of the organic material into synthetic crude oil.

We expect to optimize the catalytic upgrading of bitumen in $scCO_2$ by modification of reaction conditions including pressure ($CO_2$ and $H_2$), nature and type of catalyst, and reaction time. In order for this technology to be successful commercially, it is advantageous that the lowest effective temperatures, pressures and reaction times are identified. While the results listed in TABLE VIII and depicted in FIG. 16 and FIG. 17 are very significant, low-temperature SCF hydroprocessing of bitumen remains largely uncharacterized. We expect that other SCF media (including mixtures of solvents), and a range of heterogeneous catalysts will prove useful in this technology. We believe that variation in $H_2$ pressure; SCF pressure; reaction time; temperature and concentration; nature of catalyst (metal/support/loading); amount of catalyst; recyclability of catalyst; and the addition of a co-solvent will all prove useful.

It is expected that the other SCFs listed in TABLE IX will be useful for an upgrading medium; these solvents have been chosen as their critical parameters indicate that they, or mixtures of them, will be miscible with bitumen under moderate conditions of temperature and pressure (below 250° C. and 700 psi total pressure, including $H_2$).

Light alkanes convert to SCFs in an intermediate temperature range (ca. 100-350° C.), and are a potential alternative to $CO_2$. For example, sc propane has been demonstrated as a direct extraction medium, and the recovery of bitumen from mined tar sands using a light hydrocarbon liquid is a patented technology. In the temperature regime spanned by sc hexane, thermal rearrangement of the carbon skeleton becomes accessible. For example, alumina-supported noble metal catalysts have been used in the ring-opening of naphthalene and methylcyclohexane at 350° C., and substantial isomerization of the ring-opened products was observed. Bitumen upgrading has also been shown to be successful in a range of alkane SCFs (dodecane, decane, decalin) at temperatures >400° C. We expect to be able to achieve similar results employing SCFs with more amenable critical parameters, such as n-propane ($T_c$=97° C., $T_p$=609 psi) and n-hexane ($T_c$=266° C., $T_p$=439 psi). One concern with alkane solvents is the likelihood of asphaltenes being insoluble in these media. Accordingly, we expect to add polar co-solvents, such as toluene or methanol, to ensure complete dissolution of the material.

Ethers such as tetrahydrofuran (THF) and dimethyl ether (DME) possess intermediate polarities, and have the potential to dissolve bituminous solutions. We expect to use scTHF or scDME as an upgrading solvent. The critical pressures of these solvents are comparatively low, and would afford either a lower total operating pressure, or the possibility of adding more $H_2$ for the same total pressure. Supercritical toluene (PhMe) is also a possible candidate for an upgrading medium, as it is the solvent of choice for extraction of bitumen. Although the critical temperature is rather high (318° C.), the critical pressure is reasonably low (597 psi), and it may therefore be a candidate. However, potential complications with this solvent include competing hydrogenation of toluene at elevated temperatures, and may preclude it from the picture.

We have used small scale, (50-250 mL) stainless steel reactors. We expect to operate at a larger scale operation (including a continuous tubular reactor) and at higher temperature Hastelloy vessels (>250° C.), to perform experiments using SCF with more demanding critical parameters.

TABLE I

| Rxn | Catalyst (mg) | Substrate (mg) | Time (hours) | P $H_2$ (psi) | P $CO_2$ (psi) | % Conversion to products* | % Fully Hydrogenated* |
|---|---|---|---|---|---|---|---|
| 1 | 15 | 15 | 4 | 900 | 2350 | 9.7 | 0 |
| 2 | 15 | 15 | 8 | 900 | 2350 | 3.2 | 0 |
| 3 | 25 | 25 | 4 | 900 | 2350 | 83.2 | 0 |
| 4 | 25 | 25 | 4 | 1300 | 2500 | 17.1 | 0 |
| 5 | 50 | 25 | 2 | 1500 | 2400 | 99.0 | 11.4 |
| 6 | 50 | 25 | 4 | 1500 | 2400 | 97.8 | 46.5 |
| 7 | 50 | 25 | 8 | 1500 | 2500 | 97.9 | 36.8 |
| 8 | 50 | 25 | 16 | 1500 | 2500 | 49.3 | 0.6 |

*analyzed by GC/MS

TABLE II

| | Literature results | | | | | This work; n-heptane ($scCO_2$)[a] | | | | |
|---|---|---|---|---|---|---|---|---|---|---|
| Substrate | Conc. (mM) | Temp. (° C.) | $pH_2$ (MPa) | Time (h) | Yield[d] (%) | Conc. (mM) | Temp. (° C.) | $pH_2$ (MPa) | Time (h) | Yield[d] (%) |
| Naphthalene[a] | 58 | 40 | 3.0 | 4 | >95 | 58 | 60 | 6.2 | 4 | >95 (>95) |
| Anthracene[b] | 20 | 350 | 6.8 | 3 | <5 | 42 | 120 (160) | 6.2 | 4 | >95 (77) |

TABLE II-continued

| Substrate | Literature results Conc. (mM) | Temp. (° C.) | $pH_2$ (MPa) | Time (h) | Yield[d] (%) | This work; n-heptane ($scCO_2$)[a] Conc. (mM) | Temp. (° C.) | $pH_2$ (MPa) | Time (h) | Yield[d] (%) |
|---|---|---|---|---|---|---|---|---|---|---|
| Phenanthrene[b] | 190 | 350 | 6.8 | 3 | <5 | 40 | 160 | 6.2 | 16 | 75 (45) |
| Pyrene[c] | 140 | 250 | 4 | 3 | 55 | 24 | 160 | 6.2 | 16 | >95 (24) |

[a]Rh/C catalyst.
[b]Co/Mo $Al_2O_3$ catalyst.
[c]Pd/Beta-H zeolite catalyst.
[d]Yield of fully hydrogenated product.

TABLE III

| Entry | Catalyst | Reaction Time (hours) | $H_2$ Pressure (MPa) | Conversion[a] (%) | Py-THQ[a] (%) | DHQ[a] (%) |
|---|---|---|---|---|---|---|
| 1 | $Rh/Al_2O_3$ | 2 | 10.8 | 100 | 25.2 | 74.8 |
| 2 | $Rh/Al_2O_3$ | 16 | 7.5 | 100 | 5.4 | 94.6 |
| 3 | Rh/C | 4 | 9.0 | 100 | 17.7 | 81.3 |

TABLE III-continued

| Entry | Catalyst | Reaction Time (hours) | $H_2$ Pressure (MPa) | Conversion[a] (%) | Py-THQ[a] (%) | DHQ[a] (%) |
|---|---|---|---|---|---|---|
| 4 | Rh/C | 16 | 9.0 | 100 | 4.8 | 95.2 |
| 5 | Rh/C | 18 | 8.0 | 100 | 4.8 | 95.2 |

[a]= determined by GC-MS

TABLE IV

| Entry | Catalyst | Reaction Temp (° C.) | Reaction Time (hours) | $H_2$ Pressure (MPa) | Conversion[a] (%) | Py-THQ[a] (%) | Ethyl-Cyclo-hexane[a] (%) | Propenyl-benzene[a] (%) | Propyl-Cyclo-hexane[a] (%) | DHQ[a] (%) |
|---|---|---|---|---|---|---|---|---|---|---|
| 1 | Pd/C | 200 | 16 | 8.8 | 97.9 | 97.9 | 0 | 0 | 0 | 0 |
| 2 | $Rh/Al_2O_3$ | 100 | 36 | 7.6 | 96.9 | 96.3 | 0 | 0 | 0 | 3.6 |
| 3 | Ru/C | 100 | 16 | 8.6 | 87.9 | 84.2 | 0 | 0 | 0 | 3.7 |
| 4 | Ru/C | 100 | 24 | 8.3 | 67.0 | 55.1 | 0 | 0 | 5.9 | 6.0 |
| 5 | Rh/C | 100 | 20 | 8.0 | 98.0 | 96.2 | 0 | 0 | 0 | 1.8 |
| 6 | $CoMoS_4/TiO_2—Al_2O_3$ | 200 | 16 | 9.5 | 97.7 | 46.1 | 34.4 | 17.2 | 0 | 0 |

[a]= determined by GC-MS

TABLE V

| Entry | Reaction temperature (° C.) | Reaction time (hours) | Substrate | $H_2$ Pressure (MPa) | Conversion[a] (%) | Partial hydrogenation[a] 2 (%) | Ethyl benzene[a] 3 (%) | Ethyl cyclohexane[a] 4 (%) |
|---|---|---|---|---|---|---|---|---|
| 1 | 160 | 16 | Benzothiophene[b] | 10.3 | 49.7 | 49.7 | 0 | 0 |
| 2 | 180 | 18 | Benzothiophene[b] | 10.3 | 85.8 | 85.8 | 0 | 0 |
| 3 | 180 | 18 | Benzothiophene[b] | 18.9 | 74.1 | 66.8 | 7.3 | 0 |
| 4 | 180 | 20 | Benzothiophene[c] | 15.5 | 94.5 | 14.8 | 79.8 | 0 |
| 5 | 200 | 20 | Indole[d] | 7.2 | 39.8 | 0 | 25.6 | 14.1 |
| 6 | 200 | 20 | Indole[e] | 7.2 | 35.2 | 10.0 | 15.2 | 8.9 |
| 7 | 200 | 20 | Indole[f] | 16.5 | 38.3 | 23.2 | 15.1 | 0 |

[a]= determined by GC-MS,
[b]$Rh/Al_2O_3$,
[c]$Pd/Al_2O_3$,
[d]Rh/C (dry)
[e]Pd/C,
[f]$NiMoW/Al_2O_3$

TABLE VI

| Entry | Reaction temperature (° C.) | Reaction time (hours) | Substrate | $H_2$ Pressure (MPa) | Conversion[a] (%) | Partial hydrogenation[a] 2 (%) | Ethyl benzene[a] 3 (%) | Ethyl cyclohexane[a] 4 (%) |
|---|---|---|---|---|---|---|---|---|
| 1 | 180 | 24 | Benzothiophene[b] | 15.5 | 21.7 | 19.1 | 2.6 | 0 |
| 2 | 180 | 20 | Benzothiophene[b] | 15.2 | 43.2 | 37.8 | 5.4 | 0 |
| 3 | 180 | 20 | Benzothiophene[c] | 16.9 | 54.2 | 49.6 | 4.6 | 0 |

TABLE VI-continued

| Entry | Reaction temperature (° C.) | Reaction time (hours) | Substrate | $H_2$ Pressure (MPa) | Conversion[a] (%) | Partial hydrogenation[a] 2 (%) | Ethyl benzene[a] 3 (%) | Ethyl cyclohexane[a] 4 (%) |
|---|---|---|---|---|---|---|---|---|
| 4 | 200 | 18 | Indole[d] | 7.6 | 32.2 | 31.7 | 0.5 | 0 |
| 5 | 200 | 18 | Indole[e] | 7.6 | 31.8 | 34.0 | 0.2 | 0 |

[b]Pd/Al2O3,
[c]Rh/Al2O3,
[d]Rh/C (wet),
[e]Rh/C (dry)

TABLE VII

| Entry | Reaction tempterature (° C.) | $H_2$ Pressured (MPa) | Conversion (%) | Reaction time (hours) | Ethyl cyclohexane[a] 2 (%) | Propenyl benzene[a] 3 (%) | Hept-2,4,6-enyl benzene[a] 4 (%) | Propyl cyclohexane[a] 5 (%) |
|---|---|---|---|---|---|---|---|---|
| 1[b] | 180 | 13.8 | 13.7 | 4 | 1.5 | 1.0 | 7.9 | 3.3 |
| 2[c] | 180 | 9.5 | 87.8 | 24 | 48.5 | 38.1 | 1.2 | 0 |
| 3[d] | 200 | 9.5 | 84.2 | 20 | 43.1 | 27.4 | 5.5 | 8.2 |
| 4[e] | 200 | 10.5 | 93.1 | 16 | 76.1 | 16.2 | 0.8 | 0 |

[a]= determined by GC-MS,
[b]$Pd/Al_2O_3$,
[c]$CoMoS_4/TiO_2$—$Al_2O_3$,
[d]Rh/C,
[e]$NiMoW/Al_2O_3$

TABLE VIII

| | Bitumen | | | | Oil Sands Bitumen | | |
|---|---|---|---|---|---|---|---|
| | Initial | Rh/C | CoMo/ $Al_2O_3$ | Ru/C | Initial | Rh/C | CoMo/ $Al_2O_3$ |
| API Gravity | 7.8 | 16 | 11.5 | 17.8 | 7.6 | 15.6 | 12.0 |
| % Sulfur | 3.21 | 0.4 | 1.18 | 2.0 | 5.1 | 1.3 | 2.0 |
| Ni, V (μg/g) | 100, 40 | 60, 40 | 60, 30 | <0.006, <0.009 | 180, 220 | 0.16, <0.01 | n/a |

TABLE IX

| SCF | $T_c$ (° C.) | $P_c$ (psi) |
|---|---|---|
| n-Propane, $C_3H_8$ | 97 | 609 |
| n-Hexane, $C_6H_{14}$ | 234 | 439 |
| Dimethyl Ether, DME | 127 | 777 |
| Toluene, PhMe | 318 | 597 |
| Tetrahydrofuran, THF | 266 | 751 |

Design and Synthesis of Catalysts for Upgrading of Bitumen in SCFS.

In addition to the catalysts already described, we expect that other catalysts will be useful in this technology. Heterogeneous supported systems are likely to prove more robust and long-lived than homogeneous catalysts. For $scCO_2$ we expect to use a range of commercially available hydrogenation catalysts. We expect to also design or modify catalysts where required to increase their activity in SCFs. We expect to use heterogeneous Ni, Co, Mo and Ru systems supported on a range of materials, as these appear to offer the most promise in terms of activity, while avoiding the high costs of metals like Rh and Pt. Regeneration of the catalysts is also expected to be developed in order to make this an economical process.

It is expected that only the most robust catalysts will be compatible with the high temperature environment in SCFs with higher critical conditions. However, $\alpha$-$Al_2O_3$, $HfO_2$ and $ZrO_2$ are all physically and chemically stable under these conditions, and are expected to be used to support finely divided metal catalysts. From the chemical literature it is known that late transition metals like Fe, Ni, Ru, Rh, Pd and Pt are effective hydrogen transfer catalysts to unsaturated organic moieties including the aromatic rings of PAHs, whereas Ru and Ir are known to be good catalysts for ring-opening and olefin metathesis. Thus, development of an optimal heterogeneous supported catalyst that combines these two processes of mobilization and elimination of impurities under supercritical conditions is expected to be an iterative process, using a combinatorial approach at the outset. However, the simple expedient of e.g. impregnating $Al_2O_3$ with stock solutions of metal salts, followed by drying and reduction with $H_2$ gas has been remarkably effective in producing high activity catalysts for these types of processes. Exploration of zeolites as upgrading catalysts or supports is expected to also be conducted in our novel supercritical process.

Design and Construction of a Continuous Bench Scale SCF Bitumen Upgrading System.

Evaluation of the Upgrading of Extracted Bitumen in SCFs Using a Model Ebullated-Bed Reactor It is expected that a bench-scale continuous ebullated-bed reactor, which is the reactor technology currently used for bitumen upgrading will be useful in determining operating parameters for a continuous process. The ebullated-bed reactor is specifically designed to handle problematic heavy feeds with high amount of metals and asphaltenes, as is the case of bitumen, which presents unique technical challenges. In the case of bitumen upgrading, the ebullated bed hydrocracker (LC-Finer$^{SM}$) has been shown to increase the overall upgrading yield and product quality, and it constitutes an integral part of Syncrude's upgrading operations.

The continuous upgrading of bitumen requires the construction of a continuous ebullated-bed reactor system equipped with mantle heaters, mass flow controllers, liquid pumps, gas feed systems, high pressure gas/liquid separator, back pressure regulator, and cooling condensers.

The ebullated-bed reactor system is expected to be used in the evaluation and optimization of the following process variables:

1. Total process pressure, SCFs partial pressure, and hydrogen partial pressure
2. SCFs formulation
3. Reaction temperature
4. Hydrogen and SCFs to oil ratio and recycle gas rate
5. Space-velocity and fresh feed rate One aspect of this work is the determination of the effect of several SCF formulations and the effect of the SCF formulation-hydrogen ratio on the optimization of bitumen upgrading at low-to-moderate temperatures. The preliminary upgrading results obtained to date are very promising. These initial findings can be used in the evaluation of several SCF formulations that would have the potential of improving hydrogenation reactions because of the enhanced solubility of hydrogen in the bitumen phase. Additionally, the optimum catalysts obtained from the work described herein will be used. The overall effect of these variables on the global behaviour of bitumen processing will be determined in terms of the degree of contaminants removal; in particular, S, N, V and Ni. In addition, the degree of polyaromatic saturation, hydrodeasphaltenization, hydrocracking, and similar process results will also be determined and optimized.

Design and Construction of a Continuous Bitumen Extraction and Upgrading System in SCFS A continuous process is expected to include the steps of: soaking of oil sands in SCFs at low-moderate temperatures; separation of bitumen-SCFs mixture, sand, and water; and upgrading of extracted bitumen using a model ebullated-bed reactor.

Soaking of oil sands in SCF formulations at low-to-moderate temperature. In this step, the effect of the following variables on bitumen extraction efficiency are expected to be evaluated: (a) type of SCF formulations, (b) extraction temperature, (c) extraction time, (d) SCF and oil sands mixing approach, (e) oil sands water content, and (f) number of extraction steps. Initially, the soaking process is expected to be conducted as a batch operation to determine the optimum bitumen extraction conditions. This evaluation also includes the identification and/or adaptation of the most convenient commercial equipment available for this type of process. High pressure equipment is expected to be constructed based on operational variables and related equipment specifications.

Separation of bitumen-SCFs mixture and sand. In this step one identifies the appropriate high pressure, three phase (solid-water-hydrocarbon liquid) separation process. It is advantageous to maintain the supercritical conditions of the solvents added to the bitumen phase to ensure the efficient extraction of the bitumen from sand and fine minerals. We expect to evaluate several separation principles such as: high pressure and high speed centrifugation and high pressure filter technology (rotary pressure filter, bet filter, etc.) among others; that could be adapted to the process. Initially, this separation step will be carried out at laboratory batch scale. The optimum separation process will be embodied in a continuous reactor system and method.

Upgrading of extracted bitumen using a model ebullated-bed reactor. An optimized bitumen upgrading step is expected to be integrated with the aim of building a continuous process involving extraction and separation. It is expected to have the bitumen upgrading in SCFs process optimized from the previous research activity. The effort is expected to be channeled toward the adaptation, designed, and construction of a continuous bitumen extraction and upgrading process. The separation and recycling of SCFs and hydrogen is an important aspect of this evaluation.

Other Applicable Technology

Catalytic Gasification of Tar Sand Bitumen

The recovered liquid products from bitumen represented around 40% of the total mass, indicating that a significant fraction of the initial material was being gasified and vented with the $CO_2/H_2$ off gases on work up.

It is expected that one can gasify fractions of bitumen to volatile $C_n$ compounds at moderate temperatures using SCFs. Literature precedents report partial gasification of coal in $scH_2O$ at 400-700° C. We expect to gasify bitumen components, avoiding the forcing conditions required and corrosive nature of $scH_2O$. We expect to accomplish the gasification using SCFs with moderate critical temperatures, such as $scC_6H_{14}$($T_c$ 234.6° C.) and $scC_{10}H_{22}$ ($T_c$ 344.6° C.) with a range of catalysts such as $RuO_2$, which has proved effective for the gasification of organic compounds.

One target for gasification is the heavy ends of bitumen that contain the most complex carbon molecules, using a variety of base and noble metal catalysts in SCFs. We expect to employ $scCO_2$ as our reaction medium; however, this type of transformation will likely require reaction conditions more appropriate to the supercritical alkanes described above. Separation of the gaseous and volatile products from the solvent is expected to be made easier by use of alkanes that are liquid under ambient conditions.

Theoretical Discussion

Although the theoretical description given herein is thought to be correct, the operation of the devices described and claimed herein does not depend upon the accuracy or validity of the theoretical description. That is, later theoretical developments that may explain the observed results on a basis different from the theory presented herein will not detract from the inventions described herein.

Any patent, patent application, or publication identified in the specification is hereby incorporated by reference herein in its entirety. Any material, or portion thereof, that is said to be incorporated by reference herein, but which conflicts with existing definitions, statements, or other disclosure material explicitly set forth herein is only incorporated to the extent that no conflict arises between that incorporated material and the present disclosure material. In the event of a conflict, the conflict is to be resolved in favor of the present disclosure as the preferred disclosure.

While the present invention has been particularly shown and described with reference to the preferred mode as illustrated in the drawing, it will be understood by one skilled in the art that various changes in detail may be affected therein without departing from the spirit and scope of the invention as defined by the claims.

What is claimed is:

1. A method of extracting and upgrading carbonaceous material, comprising the steps of:

contacting a specimen of carbonaceous material with a supercritical fluid, a catalyst comprising a support selected from the group consisting of carbon and aluminum oxide and comprising a metal selected from the group consisting of Fe, Ni, Mo, W, Ru, Pd, Ir and Pt, and a source of hydrogen comprising hydrogen gas to form a reaction mixture;

maintaining said specimen of carbonaceous material with said supercritical fluid, said catalyst and said source of hydrogen in said reaction mixture at a temperature of 200° C. or less for a reaction time of at least 30 minutes; and recovering extracted hydrocarbon from said reaction mixture.

2. The method of extracting and upgrading carbonaceous material of claim 1, wherein said specimen of carbonaceous material comprises a material selected from the group consisting of an oil sand, a bitumen, an oil shale, a lignite, a coal, a tar sand, and a biofuel.

3. The method of extracting and upgrading carbonaceous material of claim 1, wherein said carbonaceous material undergoes hydrogenation.

4. The method of extracting and upgrading carbonaceous material of claim 1, wherein said specimen of carbonaceous material comprises a polycyclic aromatic hydrocarbon.

5. The method of extracting and upgrading carbonaceous material of claim 4, wherein said polycyclic aromatic hydrocarbon undergoes a ring opening reaction.

6. The method of extracting and upgrading carbonaceous material of claim 1, wherein said carbonaceous material undergoes a sulfur elimination reaction.

7. The method of extracting and upgrading carbonaceous material of claim 1, wherein said maintaining step is performed at a temperature of 160° C. or less.

8. The method of extracting and upgrading carbonaceous material of claim 1, wherein said maintaining step is performed at a temperature of 120° C. or less.

9. The method of extracting and upgrading carbonaceous material of claim 1, wherein said maintaining step is performed at a temperature of 100° C. or less.

10. The method of extracting and upgrading carbonaceous material of claim 1, wherein said maintaining step is performed at a temperature of 60° C. or less.

11. The method of extracting and upgrading carbonaceous material of claim 1, wherein said supercritical fluid comprises $CO_2$.

12. The method of extracting and upgrading carbonaceous material of claim 1, wherein said supercritical fluid comprises a hydrocarbon.

13. The method of extracting and upgrading carbonaceous material of claim 1, wherein said catalyst comprises rhodium.

14. The method of extracting and upgrading carbonaceous material of claim 1, wherein the step of recovering extracted hydrocarbon comprises recovering a liquid or gaseous product that is suitable for transport by pipeline.

15. A method of upgrading carbonaceous material, comprising the steps of:

contacting a specimen of carbonaceous material with a supercritical fluid, a catalyst comprising a support selected from the group consisting of carbon and aluminum oxide and comprising a metal selected from the group consisting of Fe, Ni, Mo, W, Ru, Pd, Ir and Pt, and a source of hydrogen comprising hydrogen gas to form a reaction mixture;

maintaining said specimen of carbonaceous material with said supercritical fluid, said catalyst and said source of hydrogen in said reaction mixture at a temperature of 200° C. or less for a reaction time of at least 30 minutes; and recovering hydrocarbon from said reaction mixture.

16. The method of upgrading carbonaceous material of claim 15, wherein the step of recovering hydrocarbon comprises recovering a liquid or gaseous product that is suitable for transport by pipeline.

17. The method of upgrading carbonaceous material of claim 15, wherein said specimen of carbonaceous material comprises a material selected from the group consisting of an oil sand, a bitumen, an oil shale, a lignite, a coal, a tar sand, and a biofuel.

18. The method of upgrading carbonaceous material of claim 15, wherein said supercritical fluid comprises $CO_2$.

* * * * *